US010641591B1

(12) United States Patent
Rubin

(10) Patent No.: US 10,641,591 B1
(45) **Date of Patent: *May 5, 2020**

(54) BIOLOGICAL ACTIVE BULLETS, SYSTEMS, AND METHODS

(71) Applicant: Darren Rubin, Largo, FL (US)

(72) Inventor: Darren Rubin, Largo, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/919,946

(22) Filed: Mar. 13, 2018

Related U.S. Application Data

(63) Continuation-in-part of application No. 15/193,801, filed on Jun. 27, 2016, now Pat. No. 9,945,650, which is a continuation-in-part of application No. 14/615,671, filed on Feb. 6, 2015, now Pat. No. 9,377,278, which is a continuation-in-part of application No. 13/461,863, filed on May 2, 2012, now Pat. No. 9,200,877.

(51) Int. Cl.
*F42B 12/54* (2006.01)
*F42B 12/72* (2006.01)

(52) U.S. Cl.
CPC ..... *F42B 12/54* (2013.01); *F42B 12/72* (2013.01)

(58) Field of Classification Search
CPC ..... F42B 12/36; F42B 12/54
USPC ..... 102/512
See application file for complete search history.

(56) References Cited

U.S. PATENT DOCUMENTS 468,580 A 2/1892 Rubin
2,113,279 A * 4/1938 Olin ..... B22F 9/08 102/501
3,763,786 A * 10/1973 MacDonald ..... F42B 12/54 102/512
3,901,158 A * 8/1975 Ferb ..... F42B 12/54 102/502
4,686,905 A * 8/1987 Szabo ..... F42B 5/02 102/444
5,101,732 A 4/1992 Schluckebier
5,515,785 A * 5/1996 Zglenicki ..... F42B 12/50 102/473
5,877,437 A * 3/1999 Oltrogge ..... B22F 1/0003 75/228
9,200,877 B1 * 12/2015 Rubin ..... F42B 12/36
9,945,650 B2 * 4/2018 Rubin ..... F42B 12/54
(Continued)

FOREIGN PATENT DOCUMENTS

RU 2009444 C1 3/1994
RU 45518 U1 5/2005
WO 0002689 A2 1/2000

OTHER PUBLICATIONS

PCT, "International Preliminary Report on Patentability", Application No. PCT/US2015/062043, dated Jun. 2, 2017, 7 pages.
(Continued)

*Primary Examiner* — Bret Hayes
(74) *Attorney, Agent, or Firm* — Dorsey & Whitney LLP

(57) ABSTRACT

A bullet projectile, not limited to a hollow point bullet, is made into a biological active bullet before loading and firing from a firearm with a method of incorporating an at least one biological active payload into an at least one externally facing cavity or channel of the bullet projectile to enhance the damage and lethality of the bullet projectile to produce at least one of embolism, infarct, necrosis, hemorrhage, enhanced loss of perfusion, anticoagulation, or a combination thereof in a target.

17 Claims, 4 Drawing Sheets

(56) References Cited

U.S. PATENT DOCUMENTS

| | | | | |
|---|---|---|---|---|
| 10,267,606 | B2 * | 4/2019 | Naud | F42B 4/02 |
| 2006/0278116 | A1 * | 12/2006 | Hunt | F42B 6/04<br>102/512 |

OTHER PUBLICATIONS

PCT, "International Search Report", Application No. PCT/US2015/062043, dated Aug. 25, 2016, 1 page.

* cited by examiner

Fig. 3A
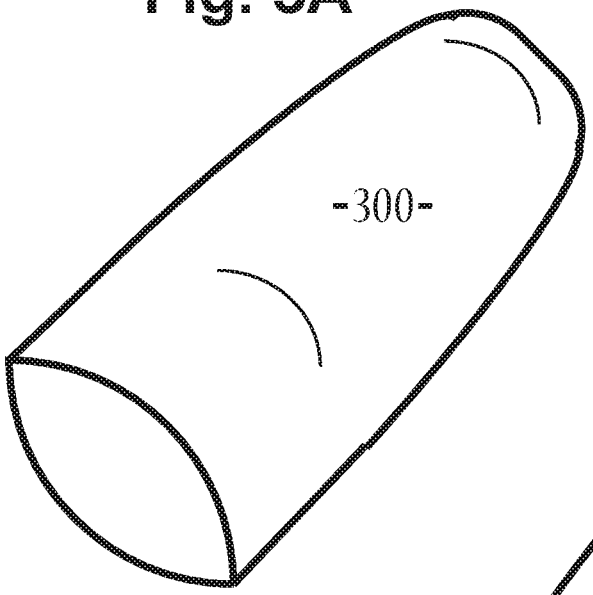
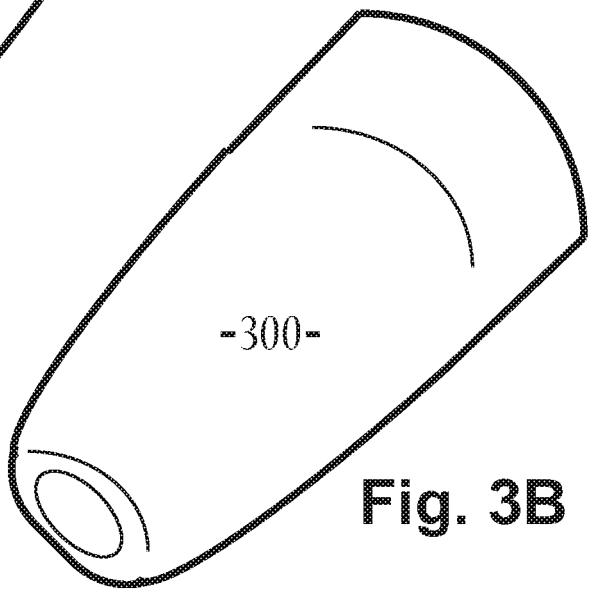
Fig. 3B
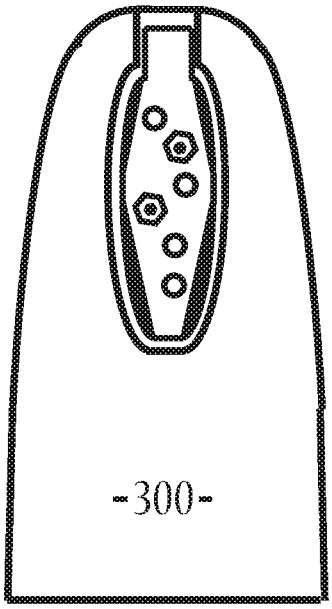
Fig. 3C

Fig. 4A
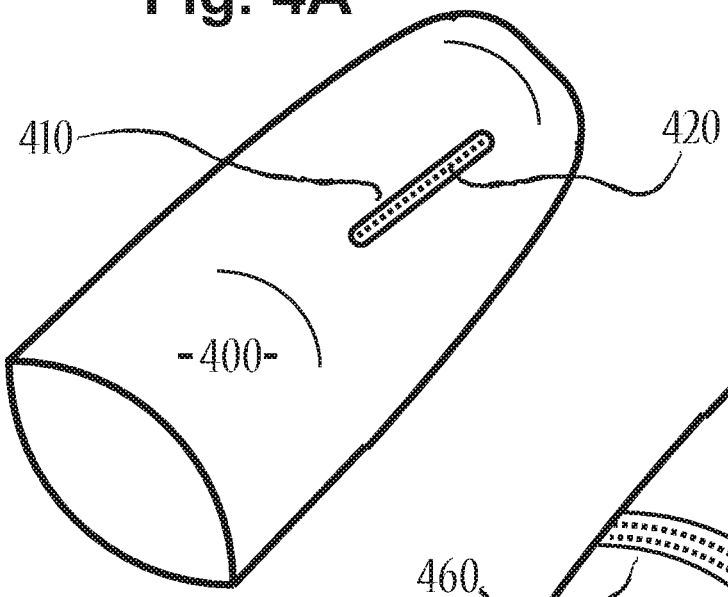
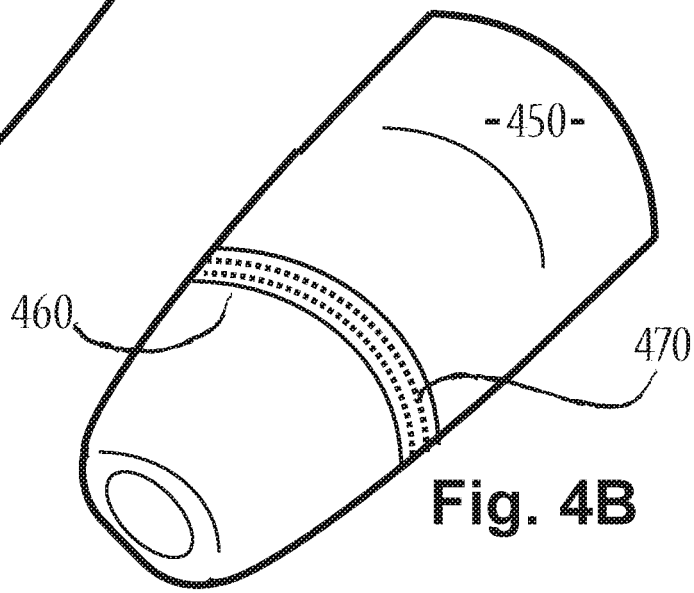
Fig. 4B

BIOLOGICAL ACTIVE BULLETS, SYSTEMS, AND METHODS

RELATED APPLICATION

The present application is a continuation-in-part of U.S. patent application Ser. No. 15/193,801 filed Jun. 27, 2016, now U.S. Pat. No. 9,945,650, which is a continuation-in-part of U.S. patent application Ser. No. 14/615,671 filed Feb. 6, 2015, now U.S. Pat. No. 9,377,278, which is a continuation-in-part of U.S. patent application Ser. No. 13/461,863 filed May 2, 2012, now U.S. Pat. No. 9,200,877, the subject matter of which is incorporated herein by reference.

BACKGROUND OF THE INVENTION

Field of the Invention

The present invention relates to a novel biological active bullet and more particularly pertains to a method for delivering at least one biological active substance to the body of a target upon bullet impact and penetration. The term "biological active substance" refers to any material that is biological, pharmaceutical, chemical, or radioactive that has at least some biological effect on or within the body of a target. This biological effect may include, but is not limited to, the interaction of this active substance with at least one of: organ systems, tissues, bodily fluids, cells, intracellular structures, and biochemicals. For instance, the desired biological effect of this biological bullet may include convulsions and disorientation that incapacitates a dangerous target. Or, the active substance delivered by this bullet may include stopping the heart or respiration of the target from an otherwise, non-fatal bullet wound. Biological active bullets can have the potential to make every shot fatal, and thus, have the ability to conserve ammunition. The result of biological effects serve additional functions not seen in other bullets, and therefore, the present invention also includes numerous other uses and improvements, with the ability to enhance modern warfare. Furthermore, the present invention allows the delivery of biological active substances to a target from a safe distance. This may prove useful in treating or neutralizing a disoriented or rabid individual carrying an infectious agent with epidemic potential. The present invention also affords the ability to deliver a wide range of active substances and combinations of active substances, and the ability to activate a substance upon impact and penetration.

The present invention also includes a biological active cavity plug or fill, a biological active payload, to make a bullet biologically active. The present invention also includes methods of plugging or filling an externally facing cavity or channel of a bullet projectile with a biological active plug or fill, before firing, to make that bullet projectile biological active for penetration with a target. If a bullet projectile does not come manufactured with an externally facing cavity or channel, the present invention also includes the step of making an externally facing cavity or channel in an existing bullet projectile, before enhancing it with a biological active payload.

BACKGROUND

Bullets are projectiles discharged and propelled from a firearm, such as a hand gun or rifle. Bullets have the primary function of piercing a living target, such as a human enemy, such as for military combat or self-defense.

Bullets have evolved many times over several centuries, resulting in many improvements, such as modern-day, metal jacketed bullet cartridges, invented by Swiss Major Eduard Rubin in the late 1800s, as described in U.S. Pat. No. 468,580.

The firing of a bullet at a target causes ballistic trauma, otherwise known as a gunshot wound or bullet wound. A penetrating bullet causes a disruption in tissue and a cavitation in the body, which is often associated with bleeding or hemorrhage, but is not always severe or life threatening. On the battlefield or in self-defense situations, the inability to stop an enemy target can be the difference between life and death for that individual, and may allow the enemy target to cause additional current or future harm, thereby, placing additional lives in danger.

Therefore, it can be appreciated that there exists a need for enhancing damage or lethality of a bullet projectile, when desired or needed, to ensure that an otherwise non-fatal gunshot wound will permanently stop an enemy target. A more lethal shot can be vital when a soldier with a handgun is in a situation of going up against an enemy with an assault rifle or automatic weapon. Even if the enemy opponent is wearing a bullet proof vest, a normally non-fatal gunshot wound to an arm or leg would prove fatal with the current invention of enhancing a bullet projectile, not limited to a hollow point bullet, with a biological active payload.

The current invention fulfills these needs by fitting a bullet projectile with a biological active payload before firing, which is or becomes exposed and interacts with the bodily fluid of a target to produce at least one of embolism, infarct, necrosis, hemorrhage, enhanced loss of perfusion, anticoagulation, or a combination thereof. The current invention provides for biological active payloads, enhanced bullet projectiles, and methods of preparation and use.

SUMMARY OF THE INVENTION

In view of the foregoing disadvantages and limitations inherent in the known types of bullet cartridges and projectiles of known designs and configurations now present in the previous art, the present invention provides an improved bullet projectile; a bullet projectile that becomes biological active to promote at least one of embolism, infarct, necrosis, hemorrhage, enhanced loss of perfusion, anticoagulation, or a combination thereof. The present invention also provides methods of transforming a bullet projectile into a biological active bullet projectile before firing. This biological active bullet system and method has all the advantages of previous art bullet projectiles and none of the disadvantages.

To attain this, the present invention essentially comprises a bullet in a cartridge. As with most cartridges, the cartridge of the present invention generally includes a bullet, a case/shell, a propellant, such as gunpowder or cordite, a primer which ignites the propellant once the firearm is triggered, along with an annular groove and flange of the casing, at the back-end of the bullet, that aids in loading the cartridge. The bullet projectile optionally includes a jacket. Importantly, the bullet projectile includes at least one exterior/externally facing, exterior/externally exposed, cavity or channel that can receive a biological active payload comprising at least one potentially biological active substance not involved in the propelling of the bullet, and optionally an at least one nonactive substance/excipient. An externally facing cavity/channel in the general sense used here means that it is at least partially open or exposed from the main metal bullet body structure; not an interior cavity that is completely surrounded on all sides by the main metal bullet body or have no opening, which would otherwise require incorporation of the biological active payload during manufacture only. This definition allows that the externally facing cavity/channel of the present invention may be optionally covered, such as with a cap or nonmetal tip, to protect a biological active payload from the external environment and or to protect the user. The present invention can also allow in most instances that the biological active payload be added after manufacture of the bullet. The biological active payload is structured to be placed in/into this at least one exterior/externally facing, exterior/externally exposed, cavity or channel by being fitably inserted, twisted, compressed and stuffed, filled, or a combination thereof, depending on when the biological active payload selected is hard and rigid, or soft and amorphous, and whether the biological active payload's contents and or its housing or container is of a solid, semi-solid, liquid, or gel-like nature. In some embodiments, the biological active payload is or contains a liquid or nonviscous gel that solidifies after application into the cavity. In some embodiments, an adhesive, polymer or glue is utilized to ensure the biological active payload stays associated with the at least partially exterior exposed cavity before firing, and before reaching the target. In some embodiments, the biological active payload or payload housing can make use of an externally facing post/pin of a cavity during its association, such as by piercing the biological active payload or payload housing with the center post/pin found in the center of a cavity, such as often found in hollow point bullets.

The bullet with associated biological active payload is fired as a projectile from a firearm to deliver the at least one potentially biological active substance in the target upon impact and penetration. The at least one potentially biological active substance of the biological active payload reacts with a bodily fluid from the target, such as blood, to become biological active and or enhancing the damage/lethality of a bullet wound by producing at least one of embolism, infarct, necrosis, hemorrhage, enhanced loss of perfusion, anticoagulation, or a combination thereof. The biological active payload essentially comprises at least one material selected from emboli, gas bubble producing materials/substances, toxins, antigens, coagulants, anticoagulants, or a combination thereof.

By the firearm user being able to selectively modify or enhance a bullet projectile after its manufacture by choosing a biological active payload to add to, and before firing, the ammunition, this invention has additional functions and applications than previous art bullets, such as for the special forces. If an externally facing channel/cavity does not already exist in a bullet, the bullet can be worked to make such a channel or cavity before associating a biologically active payload. In one preferred embodiment, the biological active payload becomes associated with a hollow point cavity of a hollow point bullet. But other externally facing channels or cavities can be made and utilized with a biological active payload according to this invention.

The present invention also includes methods of associating the at least one potentially biological active substance to the payload and or bullet projectile, such as out in the field. The present invention also includes methods of using the biological active bullet cartridge, including loading and discharging the cartridge to affect the target with the unique features of this novel invention to enhance the lethality of the bullet projectile.

In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved biological active payload and biological active bullet projectile which has all of the advantages of prior art bullets of known designs and configurations and none of the disadvantages.

It is another object of the present invention to provide a new and improved biological active bullet system and cartridge which may be easily and efficiently manufactured and marketed by adding a biological active payload before firing.

It is a further object of the present invention to provide a new and improved biological active bullet system which is of durable and reliable constructions.

An even further object of the present invention is to provide a new and improved biological active bullet system which is susceptible of a low cost of manufacture with regard to both materials and labor, and which accordingly is then susceptible of low prices of sale, thereby making such biological active bullet system economical.

Even still another object of the present invention is to provide a biological active bullet projectile for delivering at least one biological active substance to the body of a target upon bullet impact and penetration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying descriptive matter of preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3A shows a bottom-up side view of the primary embodiment biological active bullet after leaving its cartridge.

FIG. 3B likewise shows this biological active bullet from a top-down side perspective.

FIG. 3C shows the longitudinal cross-section of this biological active bullet separate from its cartridge.

FIG. 4A shows a side view after leaving a cartridge of another biological active bullet embodiment with an alternative biological active payload configuration having externally facing side channels/cavities filled or associated with biological active payloads.

FIG. 4B shows a side view after leaving a cartridge of another biological active bullet embodiment with an alternative biological active payload configuration having one externally facing, circumferential channel/cavity filled or associated with a ring-like biological active payload.

DETAILED DESCRIPTION OF THE INVENTION

Figure 1:
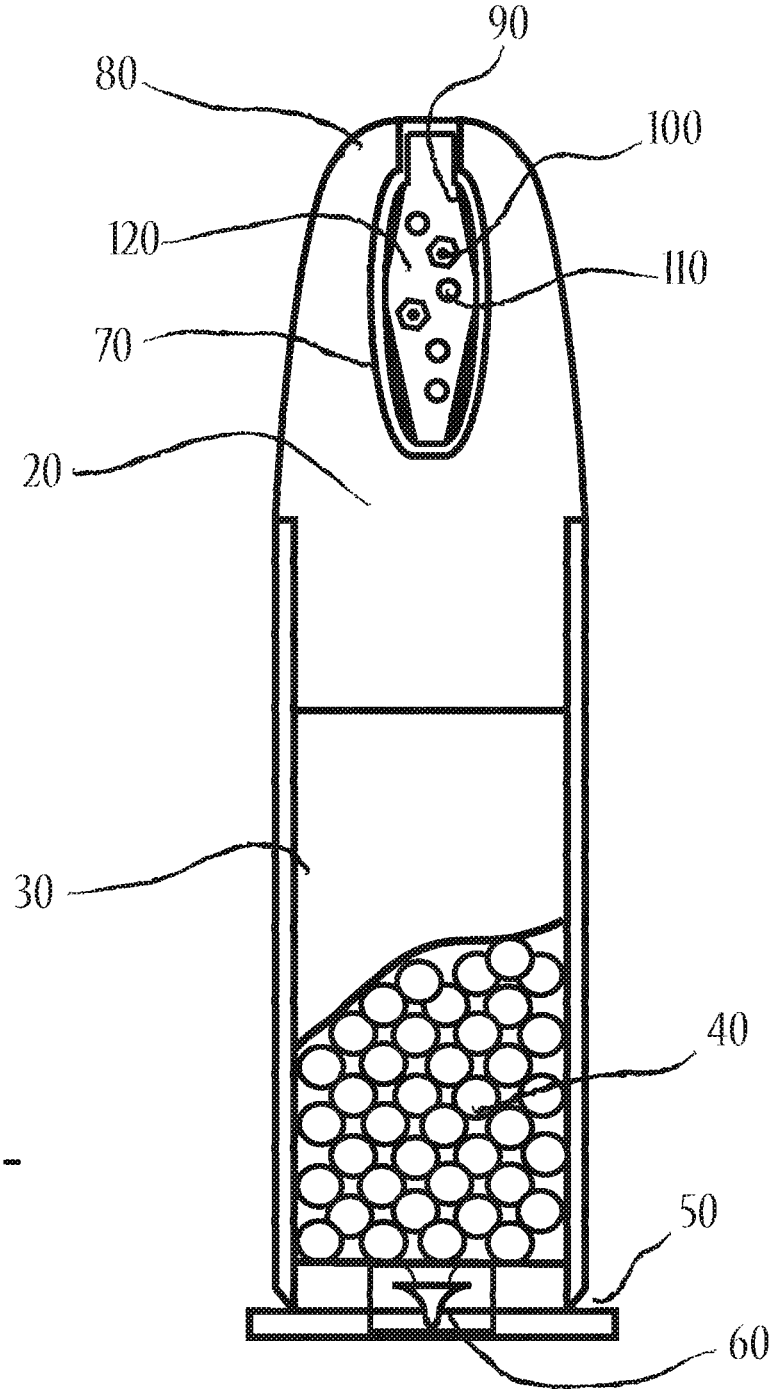
FIG. 1 is a primary embodiment of a new and improved biological active bullet cartridge, shown as a longitudinal cross-section, and revealing main components. There is a cavity near the tip of the bullet that is filled with a biological active payload resembling a cap/plug that is associated with two different potentially biological active substances.

The preferred embodiment(s) of a new and improved lethal bullet projectile, a biological active bullet system and method embodying the principles and concepts of the present invention, will be described.

The present invention is a lethal bullet projectile structured to be packaged in a cartridge/shell and structured to be discharged from a firearm and used as a weapon. Ammunitions of the present invention are preferably structured to be used with existing handguns and rifles, such as those currently used by police and the military. Accordingly, biological active projectile bullet cartridges of the present invention, in their broadest context, include a bullet, which serves as the projectile; the case/shell, which holds the cartridge components; the propellant, which may preferably be gunpowder or cordite; the primer, which ignites the propellant once the firearm is triggered; generally along with an annular groove and flange of the casing, at the back-end of the bullet, that aids in loading the cartridge or extracting the empty cartridge (i.e., an extractor groove). The bullet optionally includes a jacket. The bullet optionally includes a surface that interacts with the rifling of the firearm barrel by having grooves and or by being deformed by the riffling of the firearm barrel during discharge. Such components generally comprise a modern bullet cartridge and are not meant to be limiting. The structure of the bullet projectile, and its jacket, preferably and in most embodiments, includes solid metal and preferably has a similar look, feel, weight, and ballistics as standard issue ammunition. Importantly, the bullet projectile, not limited to a hollow point bullet, includes at least one exterior/externally facing, exterior/externally exposed, cavity or channel that can receive, and is distinguished by the use, of an at least one biological active payload comprising an at least one potentially biological active substance not involved in the propelling of the bullet projectile to a target.

The at least one potentially biological substance undergoes at least one physical effect and or chemical change when the at least one potentially biological active substance comes in contact with and interacts directly with a bodily fluid of the target, such as a non-heated bodily fluid of bodily temperature of the target, such as blood, following impact and penetration of the bullet projectile with the target. The at least one physical effect and or chemical change produces at least one result in at least one bullet wound that enhances the damage/lethality of at least one bullet wound; damage/lethality beyond that of a typical bullet wound made by the blunt force of the bullet projectile itself; including at least one of embolism, infarct, necrosis, hemorrhage, enhanced loss of perfusion, anticoagulation, or a combination thereof after interacting with said bodily fluid of said target.

The target is preferably a human target, such as a human combatant, although this weapon could also be used on an animal, such as a rabid animal or dangerous animal when a human life is in danger. Conceivable potential other hostile targets of the future can include modified, enhanced or weaponized humans and animals, and even non-terrestrial ones.

An embolism is an obstruction of a blood vessel, such as an artery, vein, or capillary, caused by a single embolus or multiple emboli; a blood clot, air bubble, fatty deposit, or physical object that has been carried in the bloodstream to lodge in a vessel and cause the embolism. While embolisms can occur naturally, the present invention includes one or more substances that induce local embolisms and pulmonary embolisms when taken into the blood vessels exposed from a bullet wound by serving as emboli (the vessel blocker) and or causing emboli formation.

In some embodiments, the at least one biological active substance is a lipid, such as a chemically modified or nondegradable synthetic lipid in solid or liquid form that can clog one or more blood vessels, while triggering an inflammatory or macrophage response. In other embodiments, the at least one biological active substance includes a lipase enzyme that hydrolyses and breaks up and mobilizes fatty deposits so they can travel and so that free fatty acids can be produced. While blunt force trauma and bone fracture from a bullet may in some very rare circumstances lead to fat embolism syndrome, this embodiment can ensure that a fat embolism proceeds to occlude pulmonary capillaries, cause infarct, and or cause pulmonary/interstitial hemorrhage that can interfere with breathing.

Gas bubbles can cause embolisms/pulmonary embolisms; themselves serving as emboli. When one or more gases are produced faster than they can escape from inside the bullet wound, these gases can apply pressure within and against the bullet wound, to force themselves inside of damaged and exposed blood vessels to cause gas embolisms. Gas bubbles with fizzing action can also propel other emboli particles into and or through blood vessels in the bullet wound to cause a pulmonary embolism. Therefore, in some embodiments the bullet projectile includes an at least one potentially biological active substance not involved in the propelling of the bullet projectile to a target that undergoes at least one gas bubble forming and or exothermic chemical reaction when the at least one potentially biological active substance comes in contact with and is triggered by and or interacts with a non-heated bodily fluid of bodily temperature of the target, following impact and penetration of the bullet projectile carrying the biological active payload to the target.

In one preferred embodiment, a biological active payload contains sodium peroxide, such as in powder form, which reacts strongly with blood because the blood contains the catalase enzyme, which produces copious fizzing and foaming as thousands of oxygen gas bubbles form to serve as emboli. Other catalytic material(s) may be included.

In another embodiment, calcium carbonate (e.g., calcite crystals) or sodium bicarbonate (e.g., in powder form) reacts with acidic solutions to produce carbon dioxide gas fizzing. So when an organic acid, such as a solid organic acid (e.g., citric acid powder) is included with a metal carbonate in the biological active payload, the wetted organic acid will interact with the metal carbonate to form carbon dioxide gas bubble emboli.

Some reactions that produce gas bubbles also produce much heat. The quantity of this at least one potentially biological active substance can be chosen based on the amount of gas bubble formation and or heat formation in the at least one exothermic chemical reaction. For example, Group I and Group II elements, including elemental lithium, elemental sodium, elemental potassium, elemental rubidium, elemental cesium, elemental calcium, elemental strontium, elemental barium, and elemental radium, along with their alloys, were found to produce violent exothermic heat along with hydrogen gas bubbles when coming in contact with aqueous bodily fluid, such as blood. For this reason, even small amounts of these substances may be cause hydrogen gas bubble emboli to form.

There are a host of other substances that can react with aqueous bodily fluid to produce a significant exothermic chemical reaction with gas bubble formation inside the bullet wound and blood vessels when used as or in a biological active payload; carbides and hydrides, such as calcium carbide and calcium hydride, acetic anhydride, phosphorus pentoxide, sodium amide, sodium hydrosulfite, sodium peroxide, to name a few. In the case of calcium carbide, acetylene gas bubble emboli are produced. These examples are not meant to be limiting, and other substances that undergo a significant reaction with aqueous bodily fluid to produce gas bubble emboli may be used for this purpose. Some of these substances produce hydroxides and gases that may further react with other substances associated with the bullet projectile or other substances in the blood. Heat from a chemical reaction can also open the contents of cells, thereby releasing additional cellular enzymes and substances that may react further.

Gas bubbles can also be released from carbonated substances; substances mixed with carbon dioxide gas under high pressure, then solidified or hardened to trap the gas until wetted by bodily fluid. Some carbonated candies are made this way; a carbonated candy would likely not release enough gas bubbles to cause an embolism inside a target. However, toxic gases trapped in a solidified syrup under high pressure, may prove more useful for this invention, such as arsine gas. Arsine can be used in this invention as it is a highly toxic inorganic compound gas that oxidizes. The heated syrup under gas pressure could be cooled in a bullet cavity, or the solid can be added to the bullet cavity after having cooled. The toxic gases are released from the solidified substance as the substance breaks down or dissolves inside the target, following bullet penetration.

In still other embodiments, the promoting of blood coagulation forms blood clots that serve as emboli. The promoting of blood coagulation is the result of the at least one potentially biological active substance absorbing and or adsorbing aqueous fluid of the blood plasma and locally hemo-concentrating blood platelets, clotting factors, and or platelet-activating mediators to initiate clotting. For instance, substances with a hygroscopic property, including natural and synthetic clay and silicate materials, and some forms of diatomaceous earth can comprise at least one potentially biological active substance of the bullet projectile. Clay minerals are hydrous aluminum phyllosilicates which form flat hexagonal sheets or plates, and include the kaolin group with minerals such as kaolinite, the smectite group with minerals such as saponite and montmorillonite, of which bentonite consists mostly of montmorillonite, the illite group, the chlorite group, and other clay minerals such as attapulgite and sepiolite. Other silicates include zeolites, which are somewhat similar to clay minerals, but instead of being plate-shaped, they form a three-dimensional crystal structure or framework characterized by numerous internal and external pores.

Zeolites are microporous aluminosilicate minerals that occur naturally in volcanic formations. As aluminosilicates, zeolites consist of silicon, aluminum and oxygen atoms. The silicon ions are neutral in the three-dimensional crystal structure, while the aluminum ion has a negative charge, which holds cations such as sodium, potassium, calcium or magnesium, or protons in the cage-like pores as counter-ions. The cations are not strongly bound to the zeolite molecule so they can be easily replaced or exchanged with other cations. The porosity and electrostatic nature of zeolites allow them to capture and hold (absorb and adsorb) vast amounts of water. Permutites are artificial aluminosilicates that resemble the zeolites. There are about 50 naturally occurring zeolites, such as natrolite, analcime, chabazite, heulandite, phillipsite, and stilbite, along with approximately 150 synthetic zeolites. When zeolites come in contact with water, a chemical reaction adsorbs the water and releases heat. In some instances, this heat may contribute to bursting platelets and blood clotting when the zeolite or permutite, such as a calcium-exchanged zeolite or permutite, is released from the biological active payload of the bullet projectile and interacts with aqueous fluid in the blood.

Some clays are known as expansive clays which experience a large volume change; they swell after absorbing water. Clay minerals especially of the smectite group, for example sodium activated bentonites, have the most dramatic swell capacity and good gelling properties. When associated and delivered by the bullet projectile, clay minerals have the potential to provide some expansive filling and or obstructing of blood vessels after interacting with and absorbing aqueous bodily fluid, such as blood plasma or lymph, which may provide a porous matrix and contact surface for clotting to take place. For instance, blood factor XII may be activated by exposure to this contact surface. Additionally, blood flowing over sharp sections of the clay may introduce mechanical shear which may activate blood factor VIII. In this way, the clotting cascade can be promoted. The one or more clay minerals associated with the bullet projectile can be in the form of powder, granules, beads, paste, gel, or electrospun with polymers.

In some embodiments, porous glass beads or glass-ceramics with a reactive surface can also provide a good surface for blood clotting to be initiated, and serve as emboli themselves.

Expansive filling and or obstructing of blood vessels and pulmonary embolism is also achieved by other swelling agents and superabsorbent polymers. Swelling with an aqueous fluid can be a physical change. Swelling agents are generally hydrophilic polymer chains that may be chemically or physically cross-linked into a three-dimensional network and able to swell up to one thousand times their own weight when placed in an aqueous environment, such as in blood plasma or lymph. The cross-linking prevents infinite dissolution. Chemical hydrogels are a class of swelling agent where all polymer chains have covalent bond cross-linking. Physical hydrogels often react with ions or other functional groups. Some swelling agents may also absorb organic materials. Some examples of swelling agents include polyvinyl alcohol polymers and polyvinylic foams, cross-linked vinyl pyrrolidone polymers, along with algae and shellfish derived chitin, chitosan, and alginate hydrocolloids. Chitin is a long polymer chain of N-acetylglucosamine, while chitosan is a long polymer of glucosamine and N-acetylglucosamine. Chitin and chitosan, and derivatives of them, perhaps because of their positive charge, have the ability to attract plasma proteins and the cell membranes of blood cells and platelets, leading to platelet activation and thrombus formation; other properties may lead to vasoconstriction. Cross-linked polyacrylic acid, such as sodium polyacrylate, is another superabsorbent polymer able to absorb up to 300 times its mass in water. After being released and or exposed to bodily fluid in the bullet wound after impact and penetration of the bullet projectile, the superabsorbent polymer is able to interact with the fluid and expand, fill, and at least partially obstruct damaged and exposed blood vessels from inside the bullet wound to accumulate or concentrate platelets and clotting factors, and promote clotting emboli and pulmonary embolisms. The expansion may also help separate or release a cap/plug or other hemostatic agents from the bullet projectile.

Other embodiments contain two or more substances that react together after impact and penetration of the bullet projectile. For example, the emboli can be a solidifying foam that expands inside the bullet wound to obstruct local blood vessels and those in or leading to the lungs. An example of a solidifying foam is one made of polyurethane, created by the mixing of polyol and isocyanates. Other embodiments include monomer and polymers that cross-link upon mixing together inside the bullet wound. An example of this are cyanoacrylates, which have adhesive like properties. Mucoadhesive properties can also help clot formation and help stop blood flow. When blood platelets are entrapped in a pore or matrix, they will begin to clot. New generation of clotting agents include peptides that self assemble into a nanofiber scaffold inside the blood, and may be delivered by the biological active payload of the bullet projectile of this invention.

Other embodiments of the invention include a bullet projectile with biological active payload containing or associated with plasma-derived or recombinant clotting factors, such as thrombin, fibrinogen and or fibrin; which delivers and releases these clotting factors inside damaged and exposed blood vessels of the bullet wound to promote clotting with the target's own blood platelets. Other clotting factors such as factor VIII and factor IX, can also be included, especially for targets with hemophilia. Clotting factors are typically inactive enzyme precursors (zymogens) of serine proteases that become active along the clotting cascade to result in the polymerization of fibrin protein which forms the clot. Natural and synthetic zymogens, enzymes, co-factors, signaling molecules and lipids, liposomes, even liposomal vesicles that can affect intracellular clotting signaling, may be included with this biological active payload. For example, thromboxane is a vasoconstrictor lipid that helps promote platelet aggregation. Platelet surface receptor fragments, such as coupled to serum albumin, may also be included in some embodiments. A host of other synthetic and derivative factors may become available for use with this invention. These examples are not meant to be limiting. If these clotting factors or clotting mediators are lyophilized, they will become active upon interaction with aqueous blood plasma. Going into solution or suspension is often a physical change.

The blood clotting cascade consists of one or more of the following clotting factors and or platelet-activating mediators, including factors:

I Fibrinogen;
II Prothrombin;
III Tissue factor or thromboplastin;
IV Calcium ions;
V Proaccelerin (Labile factor);
VII Proconvertin (Stable factor);
VIII Antihaemophilic factor A, Antihaemophilic globulin;
IX Antihaemophilic factor B, Plasma thromboplastin component, Christmas factor;
X Stuart-Prower factor;
XI Plasma thromboplastin antecedent, Haemophilia C,
XII Hageman factor;
XIII Fibrin stabilizing factor, Laki-Lorand factor;

along with platelet membrane phospholipids and tissue factors; as well as Vitamin K.

In some embodiments, clotting factors or signaling molecules may be cross-linked or covalently bound to a swelling agent or glass bead to create hybrid clotting agents.

In some embodiments, the at least one potentially biological active substance at least locally increases the viscosity of the surrounding blood fluid to reduce blood flow. In most embodiments, blood coagulation causes embolism and serve as emboli.

In still further embodiments, at least two potentially biological active substances have a synergistic effect on promoting blood clotting and or influencing bleeding or hemorrhage. Besides the example of vessel obstruction swelling agents that serve as scaffolds for blood clot emboli formation; other examples include one substance activating another substance, whether reactants in a chemical reaction, or reacting in secondary chemical reactions. An interesting example is when a foaming or gas bubble, fizzing reaction propels other emboli entering through damaged and exposed blood vessels inside a bullet wound. The foaming and or fizzing can push emboli (beads, blood clots, shards produced and or delivered by the biological active payload) through a blood vessel and help it travel to the lungs for a pulmonary embolism and or travel to the heart for a heart attack. In some instances, a pulmonary embolism can result in a heart attack, even if the emboli, such as a shard, does not obstruct a heart vessel directly. Materials delivered or biological active substances formed or delivered by the biological active payload can have a size, volume, and density chosen to travel a certain distance from the bullet wound to cause a myocardial infarction and or pulmonary embolism, and or in addition to local vessel embolism near the bullet wound. The density of the materials delivered or biological active substances formed or delivered by the biological active payload may have a density less than, greater than, or about equal to about that of blood at body temperature for these purposes of promoting or limiting/restricting travel through the blood; through the bloodstream/blood volume and of vessels.

The biological active payload can utilize other forms of minerals to cause necrosis. Mineral fibers, such as those containing silica/silicates and their derivatives, including synthetic vitreous fibers, e.g., fiberglass, and naturally occurring asbestos fibers, can cause necrosis. Fiberglass (glass wool) is generally manufactured; whereas, asbestos is a generally naturally occurring fibrous silicate with a serpentine form, such as chrysotile, and amphibole form, such as anthophyllite, grunerite (amosite), riebeckite (crocidolite), tremolite, and actinolite asbestos. Silicates can be in amorphous or crystalline forms. Asbestos fibers can have a variety of lengths, some equal to or less than 5 micrometers, or even less than 0.5 micrometers, while other can be up to 200 micrometers long or longer. Widths of asbestos fibers can vary too, such as from 0.1 to 3 micrometers or more. Metal ball milling can be used to produce smaller asbestos fiber lengths, which or more toxic to macrophages. Spicules of asbestos can penetrate tissue, such as blood vessels and capillaries. Asbestos fibers are believed to travel through the bloodstream and cause coagulative necrosis, a condition of cell death caused by lack of blood flow or poor blood flow to a part of the body. Once entering the bloodstream after delivery by said biological active projectile, it will be distributed to most organs via the blood and lymphatic systems. Coagulative necrosis can occur in organs, such as the heart and extremities. Necrosis is also caused by inflammation and fibrosis of silica fibers. For example, fibrosis of the lungs caused by asbestos prevent the perfusion of alveoli with blood and impairs gas exchange and causes breathlessness. Disruption of blood vessels can also occur from neutrophil infiltration that triggers inflammation in the walls of blood vessels. When interacting with human serum bodily fluid, asbestos and glass fibers activate the alternative complement pathway and generate chemotactic factor activity for inflammation.

Even if a target somehow survives initial necrosis or embolism, the presence of asbestos fibers in the body can lead to chronic infection as pathogen-fighting white blood cells, e.g., macrophages, will bind or take in (phagocytize) asbestos fibers and die, e.g., undergo lysis/apoptosis. Silica and or asbestos particles from the blood are also sequestered by sinusoidal mononuclear phagocytes of the liver and spleen, and also hampers the induction of natural killer cells, which also suppresses the immune system. Even if a target then somehow survives a suppressed immune system, the presence of asbestos fibers having traveled from the bullet wound via the bloodstream and depositing in the lungs will cause chronic ailments resulting from lung fibrosis, decreased lung function, mesothelioma, and other carcinoma that can be a resource drain on the enemy and prevent that combatant from ever fighting again. In other words, if death is not immediate with this embodiment, an agonizing death will likely occur within a couple years after this high exposure in the many milligrams or grams range, as asbestos will never be completely cleared from the body, and will persist to cause cellular and DNA damage and apoptosis leading to its carcinogenicity.

It is believed impossible for such fibers delivered by this projectile to be removed from the body by a doctor or surgeon because the fibers break up and are spread by the bullet and possible other biological active substances and distributed by bodily fluid to other vessels and interstitial regions and organs.

In some embodiments, the payload housing itself may be fully or partially comprised of fiberglass or asbestos fibers. Glass wool can be woven/wrapped around other biological active substances. Ideally, a portion of the payload housing would cover or coat the asbestos so that asbestos dust is not set loose upon handling the biological active payload and inhaled by the user. In other embodiments, silica/silicate fibers, such as asbestos, are alternatively or also added to melted metal when forming the metal bullet body or bullet body section(s).

In other embodiments, the silica/silicates comprise other particles, such as non-fibrous particles, microparticles, or even nanoparticles. Quartz particles can also be utilized in a biological active payload to cause silicosis, lung cancer, kidney disease, and immunological problems. Sand particles often contain quartz and other silicates, and sand may also contain calcium carbonate that can react with an organic acid. Therefore sand, or modified/milled sand, could be utilized in the biological active payload.

Fibers may also serve as clotting substrates or meshes where clots can form and cause embolism.

Minerals containing toxic elements or compounds can also be included in the biological active payload. For instance, arsenopyrite is a sulfide mineral composed of iron and arsenic sulfide. Toxic metals and toxic metalloids may also be included. Arsenic (III) is extremely toxic. Radioactive minerals and substances could be utilized as well. These examples are not meant to be limiting. A large solid particle is easier to remove from the body than numerous smaller particles, which may not be removable.

Another aspect of this invention is producing hemorrhage, or excessive bleeding, from one or more blood vessels in particular, and or from the body in general. For instance, the heat produced from potentially biological active substances, e.g., Group I and Group II elemental metals, reacting with bodily fluid and undergoing an exothermic chemical reaction can burst blood vessels and damage tissue, leading to hemorrhage internally and or externally. Foaming and fizzing agents may burst certain blood vessels near the bullet wound and some distance from the bullet wound. Obstructive emboli, clotting emboli, and or swelling agents may burst blood vessels near the bullet wound and or some distance from the bullet wound, such as pulmonary vessels and heart vessels. The at least one potentially biological active substance of the least one biological active payload is selected to perform this function of bursting blood vessels or certain blood vessels. Internally, this too can lead to loss of organ perfusion.

Another aspect of this invention is to enhance hemorrhage or bleed out from the body by providing anticoagulants, such as blood thinners, as part of the at least one biological active payload. Anticoagulants can also help prevent blood clots from forming in vessels in or near the bullet wound so that clot promoting materials and or other obstructing materials/particles can travel further in the bloodstream before clotting to reach the lungs and or heart. In this way, anticoagulants can have a synergistic affect with clotting substrates as part of the biological active payload. In this manner, blood thinners can reduce the thickness of the blood to have an interplay with the density of the other at least one potential biological active substances to affect their bloodstream travel. For instance, it can be timed for blood clotting and or obstruction to accumulate to block or burst a larger vessel, such as the pulmonary artery or aorta. Anticoagulants may be chosen from the classes of blood thinners, including, but not limited to, vitamin K antagonists, especially stronger second-generation 4-hydroxycoumarins used as rodenticide anticoagulants (e.g., brodifacoum, bromadiolone, coumatetralyl, difenacoum, flocoumafen, tioclomarol), indanedione, difethialone, as well as, heparin, low molecular weight heparin and heparin derivatives, Vitamin E, animal derived anticoagulants, such as batroxobin and hementin, direct thrombin inhibitors, such as hirudin and argatroban, antithrombin protein, synthetic pentasaccharides, and other clotting factor inhibitors, or a combination thereof. Anticoagulants as the potentially biological active substance and or biological active payload can lead to bleed out from the bullet wound directly, causing enhanced loss of perfusion. Anticoagulants can be in the form of powder or pellets or gel for this invention.

Anticoagulants have the ability to prevent clotting agents from causing blood clots in or near the bullet wound, so that clotting agents can travel further via the bloodstream to other areas of the body, e.g., the lungs or heart, before clotting.

A biological active bullet is often associated with loss of organ perfusion, beyond that of a standard bullet wound, as bleeding is enhanced and embolisms block blood flow to the lungs. Loss of organ perfusion can occur with dangerously low blood pressure (severe hypotension) resulting from hypovolemic shock associated with excessive blood loss, from cardiogenic shock associated with impaired heart function, and from anaphylactic shock associated with a severe allergic response to an antigen. Anaphylactic shock is typically a strong immune response with mast cell involvement and histamine release, along with other signaling molecules in a signaling cascade. These types of circulatory shock, a medical definition, involve severe hypotension and are not to be confused with the word shock associated with being stunned from pain. The biological active bullet along with anticoagulants and hemorrhage can cause hypovolemic shock. Emboli, myocardial infarct, and toxins from the invention can impair heart function and cause cardiogenic shock. Another aspect of this invention is inducing anaphylactic shock in the target. Synthetic chemicals and toxins, venoms, certain antibodies (e.g., IgE-like antibodies), immunogenic peptides, glycoproteins, cellular receptors, and even recombinant mast cell signaling molecules, such as cytokines (e.g., Interferon gamma), as a biological active payload, could trigger anaphylaxis or anaphylactic shock in a target, along with breathing problems from bronchoconstriction. Portions of antibodies and signaling molecules and receptors, or synthetic analogues or derivatives thereof may also trigger anaphylaxis. Preferably, superantigens (called SAgs) would be included in biological active payloads causing anaphylactic shock, and can consist of anti-CD3 and Anti-CD28 antibodies or bacterial enterotoxins (e.g., Staphylococcal enterotoxin B), which cause non-specific activation of T-cells and massive cytokine release. Propeptides would like be more stable as they require cleavage for activation. Cleavage can take place once inside the body by endogenous peptidases or by co-delivered proteases. Binding of antibody, signaling molecules, antigens, and receptors represent a physical and often chemical change in structure that takes place in the biological fluid, which includes cellular fluid.

The technological difficulty of this invention is ensuring that the at least one potential biological active substance and or at least one biological active payload does not dissociate from the bullet projectile before penetrating the target, nor bleed out of the bullet wound before imparting its biological effect. Choice of potentially biological active substance and its sizing is just one factor. Self-adherent properties and structural integrity can be another factor. Additional substances and or protective mechanisms can be used to further minimize this risk. For example, the at least one biological active substance can be cross-linked to larger substances or protected in liposomal structures.

Other essential features of the biological active bullet system include the association of the new and improved bullet projectile with the at least one potentially biological active substance and or biological active payload housing; along with preventing the at least one potentially biological active substance from undergoing at least one physical and or chemical change before the impact and penetration of the bullet projectile with the target. This can include preventing the at least one potentially biological active substance from reacting during projectile firing from a firearm.

The association of the bullet projectile with the at least one potentially biological active substance and or biological active payload, not involved in the propelling of the bullet projectile to a target, can be achieved by various means. The prevention of the at least one potentially biological active substance from undergoing at least one physical and or chemical change before reaching the intended target can also be achieved by various means. The following embodiment examples provided herein are not meant to be limiting.

With reference now to the drawings, and in particular to FIG. 1 thereof, the preferred embodiment of the new and improved biological active projectile bullet embodying the principles and concepts of the present invention and generally designated by the reference numeral 10 will be described.

The present invention, the biological active projectile bullet cartridge 10 is comprised of a plurality of components. Such components in their broadest context include a bullet 20, which serves as the projectile; the case 30, which holds the cartridge components; the propellant 40, which may be gunpowder or cordite; part of the casing used for loading 50; and the primer 60, which ignites the propellant. Such components generally comprise a modern bullet. Further included is an at least one exterior/externally facing, exterior/externally exposed, cavity or channel, preexisting or made after manufacture, that can receive a biological active payload, such as cavity or hollow point region 70 near the tip 80 of the bullet. Even if optionally covered by a polymer, lid, cap, tip or other material or structure, the externally facing cavity/channel 70 is easily accessible to the user, by removing or going through this optional polymer, lid, cap, tip or other material or structure. In other words, the main/majority bullet body metal structure ideally should not have to be dissected or destroyed to access at least a portion of the externally facing cavity/channel as would a completely interior cavity surrounded by the main metal bullet structure with no accessibility to place or reach a biological active payload.

An at least one biological active payload 90 is then later inserted, twisted, stuffed, filled or a combination thereof, into this cavity or hollow point 70, which is an externally facing cavity/channel, at least before loading and firing the projectile from a firearm. In this embodiment, the at least one biological active payload 90 resembles a cap/plug, and occupies (nearly) all of cavity or hollow point region 70, and further completes a continuous surface or ogive shape of said bullet projectile. In other embodiments, the at least one biological active payload 90 only partially occupies cavity or hollow point region 70 (not shown), and so need not be in a shape of a cap/plug. The biological active payload 90 and or cavity or hollow point region 70 may be associated with at least one adhesive material or other excipient to aid in its association to the other. If the bullet 20 or its jacket is made out of a magnetic material, such as steel, then it can be envisioned that a biological active payload may be associated with a magnetic material that could help it associate to the bullet. In some embodiments, the biological active payload or payload housing can make use of an externally facing post/pin of a cavity during its association, such as piercing the biological active payload or payload housing with the center post/pin found in the center of a cavity, such as in a hollow point bullet. In other embodiments, the biological active payload can make use of threads or partial threadings of a bullet cavity and twist or screw in.

The biological active payload 90, in a shape of a cap/plug in this embodiment, is or is associated with at least one potentially biological active substance that is delivered to a mammalian target, such as a human. The at least one potentially biological active substance is or becomes an at least one embolus, gas bubble producing material, toxin, antigen, coagulant, anticoagulant, or a combination thereof, when coming in contact with, and or interacting with, a target's bodily fluid, such as blood, inside the bullet wound. The at least one potentially biological active substance therefore produces at least one of embolism, infarct, necrosis, hemorrhage, enhanced loss of perfusion, anticoagulation, or a combination thereof after interacting with said bodily fluid of said target. In most embodiments, the at least one potentially biological active substance undergoes at least one physical and or chemical change when the at least one potentially biological active substance comes in contact with a bodily fluid of the target, including blood, following impact and penetration of the bullet projectile with the target.

FIG. 1 is shown with two groups of potentially biological active substances, group A particles 100 and group B particles 110, although any number or combination of different potentially biological active substances may be present. In one example, group A particles 100 are comprised of anticoagulants, and group B particles 110 consist of coagulants/clotting factors. Anticoagulants have the ability to prevent clotting agents from causing blood clots in the bullet wound, so that clotting agents can travel via the bloodstream to other areas of the body, e.g., the lungs or heart, before clotting. The anticoagulants also increase the chance for target bleed-out. In another example, group A particles 100 undergo an exothermic reaction when contacting blood, which opens up additional tissues and blood vessels and produces fizzing action so that group B particles 110, such as emboli or swelling agents or toxins, can enter these vessels more easily. These examples are neither exhaustive nor limiting.

The biological active payload 90 may be comprised of a payload housing 120 that is either non-hollow, or hollow as shown in FIG. 1 that contains the at least one potentially biological active substance. This payload housing 120 is structured to be inserted, twisted, stuffed, filled or a combination thereof into an at least one externally facing cavity/channel 70 of a bullet projectile 20. This payload housing 120 may be comprised of material that is rigid, semi-rigid, non-rigid, resilient, frangible, or non-frangible. This biological active payload 90 and or payload housing 120 may stay intact upon impact or may fragment. This payload housing 120 may be porous and have active substances embedded in it, or may dissolve when in contact with bodily fluids, thereby releasing one or more emboli, gas bubble producing materials, coagulants, anticoagulants, toxins, antigens, or a combination thereof. In alternative embodiments, this payload housing 120 may consist of an active substance itself or as a mixture of the active substance with other excipients. In other words, this payload housing 120 may serve as a vial containing active substances, or serve as a scaffold for holding and delivering active substances, or function like a tablet. In some embodiments, payload housing 120 consists of a fibrous or electrospun material, that may be gauze-like or fabric-like, and itself be an embolus, and or have other agents associated or embedded in it. In a preferred example, the payload housing can be comprised of synthetic vitreous fibers, glass fibers, or asbestos and thus serve as a biological active substance upon impact and penetration as the fibers separate and spread via the bloodstream to cause necrosis.

Figure 2:
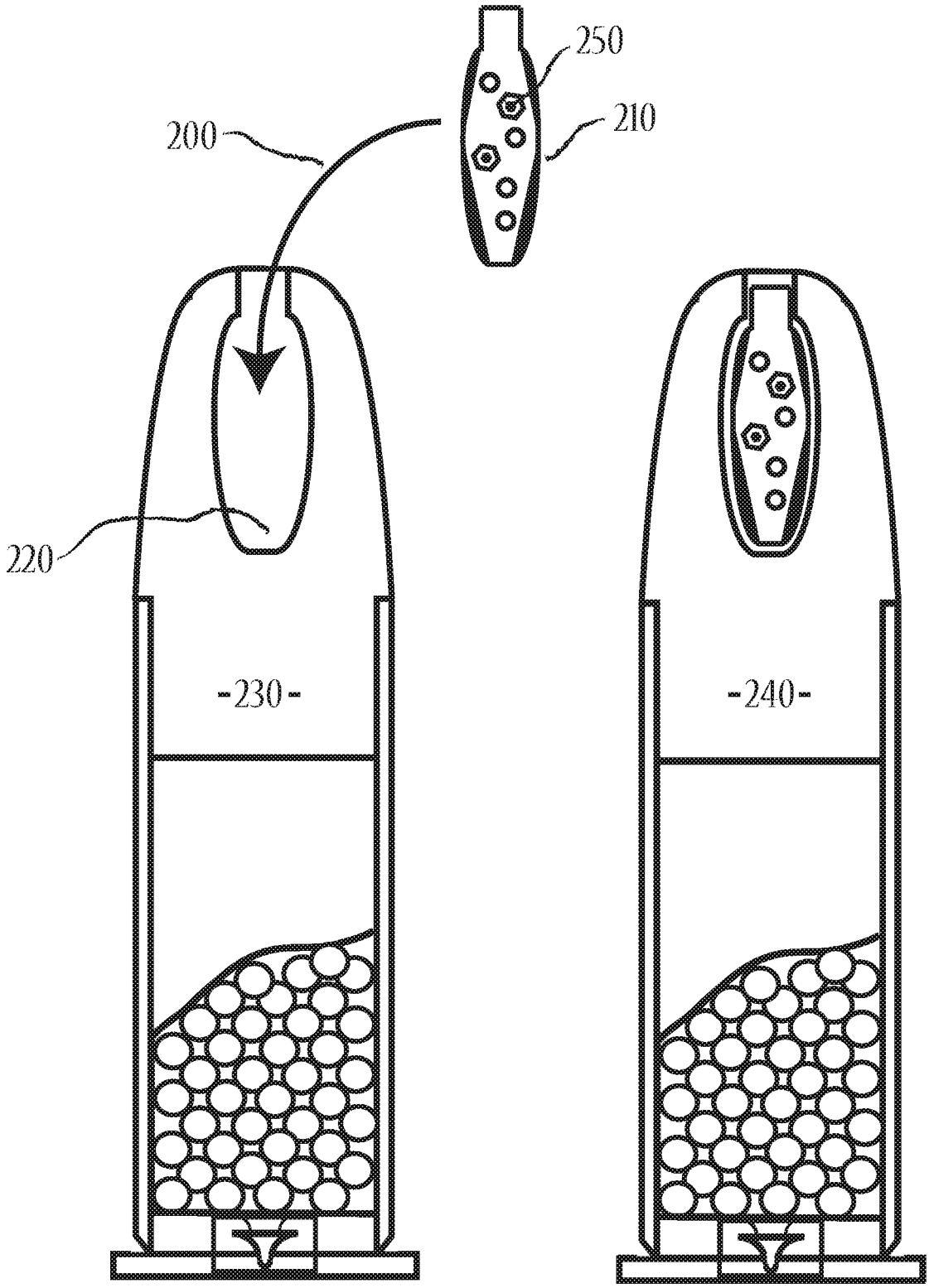
FIG. 2 describes the method of assembling this biological active payload of the primary embodiment into the empty hollow cavity of the bullet. Longitudinal cross-sections are shown.

FIG. 2 describes the method of biological active assembly; converting a standard bullet into a biological active bullet; as shown by directional arrow 200, of inserting, twisting, stuffing, filling, or a combination thereof, the biological active payload 210 into at least one hollow externally facing cavity/channel 220 of bullet 230, after bullet fabrication and before loading the assembled cartridge 240 into a firearm and discharging the biological active bullet projectile. Biological active payload 210 with its payload housing may be first compressed when associating into the bullet projectile cavity so that it uncompresses and expands, to fit better in the cavity/channel, and or can later more easily expose its surface area in the bullet wound environment. Biological active payload 210 with housing is associated with at least one potentially biological active substance and or embolus 250. The bullet now has a completed ogive shape. Cross-sections are shown.

FIG. 3A shows a bottom-up side view of the biological active bullet projectile 300 that has been discharged from the assembled cartridge 240 of FIG. 2, while FIG. 3B shows a top-down side view of this bullet. FIG. 3C shows the cross-section of this biological active bullet.

FIG. 4A and FIG. 4B show side views of two other biological active bullet embodiments with alternative biological active payload configurations. FIG. 4A shows a biological active bullet projectile 400 with one or more externally facing side channel/cavity 410 filled or associated with an at least one biological active payload 420. Bullet projectile 400 can be a hollow point bullet or a non-hollow point bullet. For this invention, a bullet can come manufactured with a externally facing channel/cavity, or a standard bullet without such an externally facing channel/cavity can be later modified to include such an externally facing channel/cavity, by metal shop working means, not limited to drilling, sawing, or etching, etc., so that a biological active payload can then be applied. In this example, externally facing channel/cavity 410 can be formed by drilling after manufacture, before placing the biological active payload inside 420. FIG. 4B shows another biological active bullet projectile 450 with an at least one externally facing, circumferential channel/cavity 460 filled or associated with one or more ring-like biological active payload 470. The ring-like biological active payload 470 may include elastomeric properties to fit on like a gasket or band around this circumferential channel/cavity 460. In these alternative biological active payload configurations, the cavity at the tip of the projectile is optional and optionally filled with a biological active payload. There can be synergies between two or more biological active payloads associated with the same or different biological active projectile.

Other embodiments of the bullet projectile exist which differ from the Figures shown. For example, the biological active payload may screw into a threaded cavity of the bullet projectile. In some embodiments, the biological active payload may screw into a threaded cavity at the front of the bullet projectile and serve as a bullet tip, such as to complete the bullet's ogive shape. Methods of the invention can also utilize bullet projectiles with an existing plastic cap or screw-on tip. For instance, hollow point bullets with an existing plastic filled tip can be utilized. A cavity can be drilled into this plastic cap to be filled with a biological active payload. Or, this plastic cap can be removed, modified (e.g., trimmed), then replaced after the biological active payload has been placed in the hollow point cavity. So modification of the plastic cap can be accomplished while the plastic cap is attached to the bullet, or modified after removing the cap from the bullet and putting it back in the bullet; modification including being able to receive a biological active payload and or containing a biological active payload. Rifle ammunition with a screw on tip can have its tip removed and tip modified to receive and or contain a biological active payload, and then reattached to the bullet, or have its tip modified or further modified while screwed into the bullet. Any mushrooming effect of the bullet projectile, such as with a hollow point bullet, or any frangibility of the bullet projectile and or bullet cap or tip, can also aid in releasing the at least one biological active payload in the target.

Toxic minerals are an alternative to commonly thought of toxins, including botulinum toxin or ricin, which are deadly in the nanogram to microgram range. Whereas, toxic minerals, metals, and metalloids may not be as restricted as using botulinum toxin or ricin that would very easily fit in a hollow point bullet cavity or modified bullet tip. For instance, the bullet projectile itself and or biological active payload may contain toxic amounts of arsenic, typically arsenic in its trivalent form arsenite (Arsenic III) or its pentavalent form arsenate (Arsenic V); or inorganic arsenic compounds, such as arsenic trioxide and or arsenopyrite; again, forms less restricted than arsenic organic poisons which could be used in some embodiments. Arsenic inactivates many enzymes involved in the cellular energy pathway and DNA synthesis/DNA repair, and stimulates apoptosis. Sensorimotor neuropathies resulting from toxic arsenic exposure according to this invention can occur within hours or weeks, leaving the combatant unable to continue fighting, at least until neurological, cardiovascular and respiratory symptoms incapacitate, disable, or cause death by peripheral neuropathy. The oral lethal dose in rats for grey metallic crystals of arsenic/arsenic trioxide is 15 mg/kg, and so a portion of a gram (e.g., 250 mg) to humans would likely be disabling, while about a gram or so would be deadly.

Other toxic substances, such if used by the military, are readily available as one or more rodenticide pellets and can include metal phosphides, such as zinc phosphide, which reacts with aqueous bodily fluid to produce phosphine gas and zinc hydroxides. Phosphine gas in the bloodstream can cause embolism, and the toxic effects include hypotension and weak heart beat and loss of consciousness. Other rodenticides can be utilized for the biological active payload.

In one of the simplest examples of carrying out the invention and methods is taking a clump of asbestos fibers or woven asbestos fibers and stuffing into a hollow point cavity of a hollow point bullet. A wax or adhesive can be used for the association of the asbestos (or milled glass fibers) to the bullet projectile to keep the biological active payload in place inside the hollow point bullet's cavity. A wax or adhesive can optionally bind other toxins or anticoagulants (e.g., rodenticides), such as in their powderized form. The wax or adhesive should break down/dissolve in blood and dissociate the asbestos and other biologic active substances from the bullet projectile. If a swelling agent, such as sodium polyacrylate is placed in the asbestos clump, the sodium polyacrylate can expand and separate the asbestos fibers/wad for better dispersal inside the target.

It is often important that the biological active substance does not get on or in the user of the ammunition when handling, assembling, or loading the biological active bullet projectile. For example, a protective sheath or coating of the payload housing can serve as containment for the biological active substance, such as if the biological active substance was tiny silicate fibers or asbestos that could otherwise, potentially form harmful dust.

In many of the embodiment examples, it is also important that the at least one potentially biological active substance is protected from reacting with an environment external to the bullet projectile and or biologic active payload housing before the impact and penetration of the bullet projectile with the target. Otherwise, the at least one potentially biological active substance (e.g., a reactive element or swelling agent) would likely undergo physical or chemical reaction with oxygen and moisture from atmosphere and or the combustible gases from the bullet's discharge; which would likely degrade the substance, cause it to prematurely swell, and or inactivate the substance before entering the bullet wound; and may even cause harm to the shooter, other cartridges, and or the firearm itself. As ammunition can get wet from rain or being submerged, an important feature of the invention is for the biological active payload to be weatherproof/waterproof to protect the at least one potentially biological active substance, such as before the projectile reaches its target. Water repellent materials, coatings, and even laser etched surfaces and patterns can protect the biologic active payload from moisture and liquids before reaching the target.

Therefore, the bullet projectile can further include at least one inert, excipient substance that protects the at least one potentially biological active substance from undergoing a physical or chemical change before the impact and penetration of the bullet projectile with the target. As such, the biologic active payload and or the biological active bullet projectile can further include at least one protective substance chosen from the group consisting of mineral oil, petroleum jelly, wax, and polymer that protects the at least one potentially biological active substance from undergoing a physical or chemical change before the impact and penetration of the bullet projectile. Excipients may also help insulate the at least one potentially biological active substance from the heat of firing the projectile. These examples are not meant to be limiting and other excipients or excipient classes can be used for this invention.

Yet, excipients can also play an important role in associating the bullet projectile with the at least one potentially biological active substance. Therefore, the bullet projectile can further include at least one excipient substance that at least partially associates the at least one payload housing and or potentially biological active substance with the bullet projectile at least before the impact and penetration of the bullet projectile with the target. Such excipients may also aid in associating other active substances and or other excipients. Excipients may adhere the at least one potentially biological active substance and or payload housing to an inner surface of the bullet jacket, or a surface, channel, pore, or cavitation of the bullet projectile; either directly, or indirectly via other excipients or structural materials. If the adherent excipient will touch the at least one potentially biological active substance directly, then the adherent excipient, such as a natural or synthetic resin, is selected to be unreactive with the at least one potentially biological active substance. In this case, tiny holes/pores are made in the at least one biological active payload and possibly the bullet projectile body surface as well. Then, mechanical bonds can form as the adhesive excipient seeps into these tiny holes/pores and solidifies while the adhesive excipient's cohesive forces maintain integrity. Alternatively, the adherent excipient may not touch the at least one potentially biological active substance directly. Instead, the at least one potentially reactive biological active may be encapsulated by a protective coating of or in addition to a payload housing, which itself may be an excipient or structural material. Then, the adhesive excipient may form chemical bonds (e.g., absorption or chemisorption) with the protective encapsulation without risk of reacting with the at least one potentially biological active substance before reaching a target.

Still other embodiments of the bullet projectile exist which differ from the Figures shown. For example, at least one potentially biological active substance may line a cavity of the projectile, and may be protected by other coating excipients or structures or projectile structural components. The cap/plug structure may not be utilized in some embodiments. In other embodiments of the invention, a cap/plug optionally helps seal a channel, pore, or cavitation of the bullet projectile containing the at least one potentially biological active substance. Alternatively, such a cap/plug can seal a channel, pore, or cavitation of the bullet projectile containing a vial, such as, but not limited to a glass or plastic vial, or gelatin or polysaccharide capsule shell, which contains the at least one potentially biological active substance. Again, adhesives can also be employed in these embodiments. Alternatively still, the biological active payload (or cap/plug) can be comprised of material that is rigid, semi-rigid, non-rigid, resilient, frangible, or nonfrangible. This biological active payload (or cap/plug) may stay intact upon impact or may fragment. This cap/plug or payload housing may be porous and have the at least one potentially biological active substance embedded in it, or may dissolve when in contact with bodily fluids. In some embodiments, this biological active payload housing (or cap/plug) may be comprised of the at least one potentially biological active substance itself or as a mixture, composition, or formulation of the at least one potentially biological active substance and other excipients. In other words, this biological active payload housing and or cap/plug may serve as a vial containing potentially biological active substances, or serve as a scaffold for holding and delivering potentially biological active substances, or function like a tablet, capsule, pellet, or granule.

For example, the potentially biological active substance may help form a solid of a desired shape that is adapted to fit the shape of the cavity as a cap/plug, to help retain the substance in a fixed position, so as to help prevent interference with the bullet's trajectory. In other examples, the cap/plug can be secured by the jacket of the bullet, or the cap/plug may have securing means, such as threads designed adapted to fit complementary securing means, such as threads, in the bullet cavity.

Once the biological active payload or its housing is assembled into and or associated with the bullet projectile, it is important for the biological active payload to stay inside and or associated with the bullet projectile while handling and loading. It is also important for the biological active bullet cartridge not to jam in a gun/firearm, such as when advancing the cartridge in a magazine. Associating means and methods prevent the biological active payload from unintentionally dissociating from the bullet projectile before reaching its intended target. Securing means and methods, including the use of adhesives, threads, other excipients, or a combination thereof, are utilized.

These embodiment examples are not meant to be limiting. Other structural and functional relationships of the bullet projectile and the at least one potentially biological active substance can exist.

The invention is a projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, bullets with screw-on tips, plated bullets, non-jacketed bullets, partially jacketed bullets, and jacketed bullets; and further associated with at least one potentially biological active substance to promote at least one of embolism, infarct, necrosis, hemorrhage, enhanced loss of perfusion, anticoagulation, or a combination thereof, in addition to the bullet wound. In some embodiments, the bullet projectile comprises no more than one or two bullet body portions; while in alternative embodiments, the bullet projectile comprises more than two bullet body portions or a plurality of subprojectiles.

If the at least one potentially biological active substance is a swelling agent or a substance that undergoes a bubbling reaction with aqueous fluid in the blood, the substance upon getting wet in bodily fluid may aid in the release and or dissociation of it and other biological active substances associated with the bullet projectile. Additionally, the at least one biological active substance can be made to be released along the bullet track, even before the bullet comes to rest or even if the bullet projectile were to exit through the target. Importantly, the bullet projectile of the biological active bullet system according to the invention has unexpected properties that existing bullet projectiles do not have. Therefore, the bullet projectile according to the invention represents a major advancement in bullet ammunitions technology, especially for military use. These unexpected results further enhance the lethality of the bullet projectile and represent a vast improvement over existing prior art bullets.

The bullet projectile of the present invention is capable of delivering a wide range of quantity of at least one potentially biological active substance, such as less than, up to, and over, one gram, along with different volumes and densities of these substances.

The bullet projectile of the invention is preferably structured to be discharged from a firearm; although in some alternative embodiments; the bullet projectile of the invention may be structured to be propelled by air guns or rail guns.

In preferred embodiments, the bullet projectile of the invention is structured to be propelled from a bullet propelling device, including, but not limited to, hand guns, revolvers, semi-automatic weapons, automatic weapons, rifles, and sniper rifles; although in some alternative embodiments, the bullet projectile of the invention may be structured to be propelled from shotguns.

The biological active bullet ammunition system preferably includes a cartridge containing a bullet projectile of the invention, and preferably includes a cartridge containing at least a propellant and a bullet projectile of the invention, and still more preferably, includes a cartridge containing at least a propellant, a primer, a case/shell, and a bullet projectile of the invention. The invention may also be a magazine containing at least one cartridge containing a bullet projectile according to the invention. The invention may also be a firearm, such as but not limited to a gun, containing at least one cartridge of bullet projectile according to the invention. Although less preferable, in other embodiments the firearm may also be unique in that it can be further specifically adapted to load and discharge at least one specifically adapted bullet projectile according to the invention.

Importantly, the bullet projectile is capable of making a normally non-fatal gunshot wound more fatal. The bullet projectile is also capable of maintaining adequate ballistics, such as, but not limited to, aerodynamic efficiency, synchronized spin, trajectory, and range.

The body of the bullet projectile can be comprised of at least one material chosen from the group of hard materials, including, but not limited to, aluminum, antimony, beryllium, bismuth, boron carbide, brass, bronze, chromium, cobalt, copper, gold, iridium, iron, lead, mercury, molybdenum, nickel, palladium, platinum, rhodium, silicon carbide, silver, steel, hardened steel, tantalum, tellurium, tin, titanium, tungsten, tungsten carbide, carbon fiber, depleted uranium, zinc, zirconium, metalloids, alloys, and any combinations thereof. However, in some alternative embodiments, polymers and carbon-based-materials may be used, as well as silica/silicates fibers and arsenic-containing compounds and alloys. These examples are not meant to be limiting. The polymers and other substances used in this invention do not typically function as binders to hold metal powders together as structural bullet body sections of the projectile.

The invention can be a bullet projectile comprised of one or more reactive or toxic metals or metalloids or alloys thereof. The invention can be a bullet comprised of arsenic, e.g., arsenopyrite and or Arsenic (III). The invention can be a bullet comprised of a highly reactive Group I and or Group II element or alloy. The invention can be a bullet comprised of asbestos. The invention can be a bullet comprised of fiberglass. Or the invention can be a bullet having at least one bullet body portion or section comprised of a toxic metal or metalloid. The invention can be a bullet having at least one bullet body portion or section comprised of a toxic arsenic and or a highly reactive Group I and or Group II element or alloy. Or the invention can be a bullet having at least one bullet body portion or section comprised of asbestos and or fiberglass.

The bullet projectile may further include at least one radiopaque marker, or the at least one potentially biological active substance may be radiopaque. Alternatively, the bullet projectile may further include at least one substance that responds to radio-frequency detection.

The bullet projectile is capable of including potentially biological active substances in a variety of formats, such as solids, liquids, gels, pastes, powders, fibers, spicules, films, microparticles, nanoparticles, fast-dissolving formats, slow-release formats, along with a variety of excipients that may aid the delivery of the substance(s).

The invention may also be a biological active bullet ammunition system that is able to deliver at least one substance of a wide range of different biological active substances to a target to cause a biological effect.

The invention may also be a biological active bullet ammunition system that is able to deliver a combination of different biological active substances to a target to cause a combination of biological effects, some of which may have synergy in their effects.

The at least one biological active substance may exist in an active state or a potentially active state. Substances that exist in a potentially active state require activation. Activation may be achieved by various ways, such as from interaction with the target itself, including bodily tissues and fluids, bodily enzymes, and extracellular, cellular, or mitochondrial proteins and cofactors; and or the conditions therein, such as the temperature and pH found in the body. For example, the potentially active substance may require processing by bodily protease enzymes for activation, or require mineral cofactors found in the target's blood. In other examples, activation may take place from the interaction of the substance with an excipient, other active, or other substance, also associated with the bullet. For instance, the potentially active substance may be a catalyst requiring a cofactor for significant activation. This cofactor may also be associated with the bullet, but unable to interact with the catalyst until the two substances are mixed together during impact and penetration of the bullet.

The invention may also be an interchangeable cap/plug or screw-on tip and biologic active bullet system, so that a cap/plug associated with at least one potentially biologic active substance and or payload can be interchanged with a cap/plug associated with a different potentially biologic active substance, so as to vary/customize the desired biologic effects using the same cartridge platform.

The invention may also be a non-interchangeable cap/plug or screw-on tip and biologic active bullet system, so that a cap/plug associated with at least one potentially biologic active substance or payload cannot be interchanged with a cap/plug or screw-on tip associated with a different potentially biologic active substance, the bullet and bullet cavity are adapted to fit only a specific cap/plug or screw-on tip associated with a certain biologic active substance, so as to prevent confusion and tampering of the bullet system.

The invention also includes methods of constructing and manufacturing the bullet projectile with cavitation for assembly with at least one potentially biological active substance, along with methods of use of the bullet projectile, including, but not limited to, methods of loading and firing the bullet projectile, methods of delivering with this bullet at least one potentially biological active substance to a target, along with methods of use of ensuring enhanced lethality from the activity of the biological active substance.

The invention may also be a method of timing and or staging the biological effects of one or more biological active substances delivered by this projectile and method. For instance, the projectile may cause respiratory distress, followed by mesothelioma, followed by cancer death over the course of a selected time period (e.g., two years).

The invention may also be a method of applying a potentially biological active substance within a cavity of a bullet, chosen from bullet cavities, such as, but not limited to, a hollow point cavity. The invention may also be a hollow point bullet projectile with at least one potentially biological active substance occupying at least some portion of the hollow point cavity. The invention may also be a method of applying an at least one potentially biological active substance to deep within a cavity of a bullet, chosen from bullet cavities, such as, but not limited to, a hollow point cavity, such as to ensure that the at least one potentially biological active substance cannot be touched by the firearm user, such as by not coming into contact with the with hands or fingers, when handling the bullet cartridge.

The invention is an at least one biological active payload structured to be inserted, twisted, stuffed, filled, or a combination thereof into an at least one externally facing cavity/channel of a bullet projectile, such as, but not limited to, a hollow point bullet. This bullet projectile is structured to be packaged in a cartridge/shell and structured to be discharged from a firearm and used as a weapon to produce at least one bullet wound in a target. This at least one biological active payload is inserted, twisted, stuffed, filled, or a combination thereof into the at least one externally facing cavity/channel of the bullet projectile at least before firing this bullet projectile from a firearm. The at least one biological active payload is at least partially exposed or accessible from, or not completely surrounded by, the bullet projectile (the main/majority metal bullet body section(s) of the bullet projectile), before the bullet projectile reaches a target so that the at least one biological active payload easily, quickly or immediately comes in contact with a bodily fluid from the target upon impact and penetration of this bullet projectile. The at least one biological active payload enhances the damage and or lethality of a bullet wound by interacting with the bodily fluid of the target, such as blood, to produce at least one result selected from embolism, infarct, necrosis, hemorrhage, enhanced loss of perfusion, anticoagulation, or a combination thereof.

This at least one biological active payload comprises at least one embolus, at least one gas bubble producing material/substance, at least one coagulant, at least one antigen, at least one anticoagulant, or a combination thereof. Ideally, the at least one coagulant causes a pulmonary embolism in the target. The at least one anticoagulant hastens and increases excessive blood loss/bleed out from the bullet wound. The at least one anticoagulant can allow or ease the spread of the other substance, such as an emboli or coagulant or toxin, in the bloodstream. Alternatively, or in addition to, all or at least one of these substances, the at least one biological active payload comprises at least one toxin selected from silica/silicate-containing minerals, synthetic vitreous fibers, asbestos, arsenic, arsenic-containing minerals/compounds, or a combination thereof.

This at least one biological active payload is further associated with an at least one adhesive, glue, wax, or polymer.

This at least one biological active payload can further complete a continuous surface or ogive shape of the bullet projectile, and may resemble or serve as a cap/plug or tip, or other bullet body structure.

The invention is also an at least one payload housing structured to be inserted, twisted, stuffed, filled, or a combination thereof into an at least one externally facing cavity/channel of a bullet projectile. The bullet projectile is structured to be packaged in a cartridge/shell and structured to be discharged from a firearm and used as a weapon to produce at least one bullet wound in a target, such as a human or animal target. The at least one payload housing is filled/associated with a biological active material/substance to form an at least one biological active payload prior to placing this at least one payload housing into the at least one externally facing cavity/channel of the bullet projectile. The at least one biological active payload is inserted, twisted, stuffed, filled, or a combination thereof, into the at least one externally facing cavity/channel of the bullet projectile before firing this bullet projectile from said the firearm. The at least one biological active payload is at least partially exposed or accessible from, or not completely surrounded by, the bullet projectile (the main/majority metal bullet body section(s) of the bullet projectile), before the bullet projectile reaches a target so that the at least one biological active payload easily, quickly or immediately comes in contact with a bodily fluid from the target upon impact and penetration of this bullet projectile. The at least one biological active payload enhances the damage/lethality of a bullet wound by interacting with a bodily fluid of this target. The at least one biological active payload produces at least one of embolism, infarct, necrosis, hemorrhage, enhanced loss of perfusion, anticoagulation, or a combination thereof, after interacting with the bodily fluid of the target. The at least one biological active material/substance comprises at least one material/substance selected from emboli, gas bubble producing materials/substances, toxins, antigens, coagulants, anticoagulants, or a combination thereof. The at least one biological active payload may further or optionally be associated with an at least one adhesive and or nonactive substance or material.

The invention is also a method of transforming a bullet projectile into a biological active bullet projectile before loading and firing from a firearm by inserting, stuffing, filling, or a combination thereof an at least one biological active payload into an at least one externally facing cavity/channel of the bullet projectile.

The invention is also a method of transforming a bullet projectile into a biological active bullet projectile before loading and firing from a firearm by first filling/associating an at least one payload housing with a biological active material/substance to form a biological active payload, and next inserting, twisting, stuffing, filling, or a combination thereof said biological active payload into an at least one externally facing cavity/channel of said bullet projectile.

The invention is also a method of transforming a payload housing into a biological active payload by filling/associating the payload housing with a biological active material/substance, such as before or after associating the payload housing with the bullet projectile.

The inventive methods can allow a firearm user, such as special forces, to customize the biological effect they want to have on their target, by selecting biological active cartridges or adding biological active substances or payloads to bullet cartridges even out in the field.

The invention includes methods of using a bullet projectile structured to be packaged in a cartridge/shell and structured to be discharged from a firearm and used as a weapon to produce at least one bullet wound in a target. The bullet projectile includes, and is distinguished by the use of, at least one potentially biological active substance not involved in the propelling of the bullet projectile to the target. The at least one potentially biological active substance undergoes at least one physical and or chemical change when the at least one potentially biological active substance comes in contact with and is triggered by and interacts with a bodily fluid of the target, such as blood, following impact and penetration of the bullet projectile with the target.

The invention also includes methods of distributing after delivery an at least one biological active substance or material or payload through at least twenty percent of the target's bloodstream/blood volume, and preferably through at least fifty percent of the target's bloodstream/blood volume, and more preferably, throughout the target's bloodstream/blood volume. Distributing includes dispersing and spreading and transporting this at least one biological active substance or material or payload through multiple blood vessels to different regions of the target's body.

The promoting blood coagulation in a blood vessel can also be the result of the at least one potentially biological active substance providing a reactive surface that serves as a clotting substrate.

The promoting blood coagulation in a blood vessel can also be the result of the at least one potentially biological active substance providing a porous surface or matrix to accumulate blood platelets, clotting factors, and or platelet-activating mediators for initiation of clotting to place on.

The promoting blood coagulation in a blood vessel can also be the result of the at least one potentially biological active substance attracting blood platelets with an electrostatic charge for the blood platelets to accumulate and activate a clotting cascade.

The promoting blood coagulation in a blood vessel can also be the result of the at least one potentially biological active substance having a mucoadhesive property of attaching to tissues and or blood platelets for the blood platelets to accumulate and activate a clotting cascade.

The promoting blood coagulation in a blood vessel can also be the result of at least one potentially biological active substance swelling many times its initial volume within a blood vessel.

The promoting blood coagulation in a blood vessel can also be the result of at least one potentially biological active substance forming a solidifying foam within a blood vessel.

Embolisms/pulmonary embolisms result from blood coagulation in this invention.

The expansive filling and obstructing in a blood vessel can also be the result of at least one potentially biological active substance forming a solidifying foam within the bullet wound.

The promoting blood coagulation in a blood vessel can also be the result of at least one potentially biological active substance polymerizing within the blood vessel.

The expansive filling and obstructing in a blood vessel can also be the result of at least one potentially biological active substance polymerizing within the bullet wound.

The promoting blood coagulation in a blood vessel can also be the result of at least one potentially biological active substance self-assembling into a matrix or scaffold for blood clotting to take place on.

The invention may also be a method of manufacturing at least one bullet projectile and or cartridge according to the invention.

The invention may also be a method of adding at least one potentially biological active substance to at least one payload housing/biologic active payload housing and or bullet projectile according to the invention.

The invention is also a bullet projectile comprised of, and delivering to a target, toxic amounts of at least one of an arsenite, an arsenate, an arside, an arseno group, an arsenopyrite, a cacodylate, an arsenobetaine, an arsinic acid, an arsanilic acid, or a combination or derivative thereof, preferably with a weight percent of at least one percent of the biological active bullet projectile; such as part of or throughout the bullet body of the projectile shown as 300, 400, and or 450 in the FIGS. 3A-4B, and or the biological active payload or substance 90, 100, 420, and or 470 of FIGS. 1, 4A, and 4B. The bullet projectile is a biological active bullet projectile as these materials and substances are made to be toxic to bodily fluid.

The invention may also be a method of adding at least one inactive substance to at least one bullet biologic active payload and or projectile according to the invention.

The invention may also be a method of adding at least one excipient to at least one biologic active payload and or bullet projectile according to the invention.

The invention may also be a method of adding at least one potentially biological active substance or payload to at least one bullet projectile according to the invention using at least one excipient.

The invention may also be a method of switching potentially biological active substances in at least one bullet projectile and or payload according to the invention The method may also include the adding or switching of potentially biological active substances and or other active substances out in the field, and or switching biological active payloads. Again, an at least one potentially biological active substance is or is part of a biological active payload.

The invention may also be a method of stabilizing over time a bullet projectile according to the invention and or at least one of its potentially biological active substance and or biological active payloads.

The invention may also be a method of storing a bullet projectile and or biological active payload according to the invention.

The invention may also be a method of labeling and identifying a bullet projectile and or biologic active payload according to the invention.

The invention may also be a method of loading into a firearm, such as but not limited to a gun, at least one magazine or projectile cartridge of one or more bullet projectile according to the invention.

The invention may also be a method of discharging/firing from a firearm, such as but not limited to a gun, at least one bullet projectile according to the invention.

The invention may also be a method of tracking a bullet projectile according to the invention after it has been discharged.

The invention may also be a method of activating an at least one potentially biologic active substance of a bullet projectile according to the invention after it has been discharged and or penetrated a target.

The invention includes a bullet projectile structured to be packaged in a cartridge/shell and structured to be discharged from a firearm and used as a weapon to produce at least one bullet wound in a target. The bullet projectile includes, and is distinguished by the use of, at least one potentially biological active substance not involved in the propelling of the bullet projectile to the target. The at least one potentially biological active substance undergoes at least one physical and or chemical change when the at least one potentially biological active substance comes in contact with and is triggered by and interacts with a bodily fluid of the target, such as blood, following impact and penetration of the bullet projectile with the target.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those described in the specification are intended to be encompassed by the present invention.

Therefore, the foregoing is considered as descriptive only of the principles of the invention. Further, since numerous modifications and changes will readily occur to those skilled in the art, it is not desired to limit the invention to the exact construction and operation described, and accordingly, all suitable modifications and equivalents may be resorted to, falling within the scope of the invention.

What is claimed as being new and desired to be protected by Letters Patent of the United States is as follows:

1. An at least one biological active payload structured to be inserted, twisted, stuffed, filled, or a combination thereof into an at least one externally exposed cavity/channel of a bullet projectile; said bullet projectile structured to be packaged in a cartridge/shell and structured to be discharged from a firearm to produce at least one bullet wound in a target; said at least one biological active payload being at least partially exposed to the external environment from said bullet projectile before said bullet projectile reaches said target so that said at least one biological active payload immediately comes in contact with a bodily fluid from said target upon impact and penetration of said bullet projectile; said at least one biological active payload enhancing damage/lethality of the at least one bullet wound by interacting with said bodily fluid of said target to produce at least one of embolism, infarct, necrosis, hemorrhage, enhanced loss of perfusion, anticoagulation, or a combination thereof.

2. The at least one biological active payload as set forth in claim 1 comprising at least one embolus.

3. The at least one biological active payload as set forth in claim 1 comprising at least one gas bubble producing material/substance.

4. The at least one biological active payload as set forth in claim 1 comprising at least one coagulant that causes an embolism/pulmonary embolism in said target.

5. The at least one biological active payload as set forth in claim 1 comprising at least one antigen/superantigen that causes anaphylactic shock in said target.

6. The at least one biological active payload as set forth in claim 1 comprising at least one anticoagulant.

7. The at least one biological active payload as set forth in claim 1 comprising at least one anticoagulant that hastens and increases excessive blood loss/bleed out from the bullet wound.

8. The at least one biological active payload as set forth in claim 1 comprising at least one toxin selected from silica/silicate-containing minerals, synthetic vitreous fibers, asbestos, arsenic, arsenic-containing minerals/compounds, or a combination thereof.

9. The at least one biological active payload as set forth in claim 1 further associated with an at least one adhesive.

10. The at least one biological active payload as set forth in claim 1 further completing a continuous surface or ogive shape of said bullet projectile.

11. A method of transforming a bullet projectile into a biological active bullet projectile before loading and firing from a firearm by inserting, twisting, stuffing, filling, or a combination thereof, an at least one biological active payload as described in claim 1 into an at least one externally facing cavity/channel of said bullet projectile.

12. A method of transforming a payload housing into a biological active payload described in claim 1 by filling/associating said payload housing with a biological active material/substance.

13. An at least one payload housing structured to be inserted, twisted, stuffed, filled or a combination thereof into an at least one externally exposed cavity/channel of a bullet projectile; said bullet projectile structured to be packaged in a cartridge/shell and structured to be discharged from a firearm to produce at least one bullet wound in a target; said at least one payload housing filled/associated with a biological active material/substance to form an at least one biological active payload; said at least one biological active payload being at least partially exposed to the external environment from said bullet projectile before said bullet projectile reaches said target so that said at least one biological active payload immediately comes in contact with a bodily fluid from said target upon impact and penetration of said bullet projectile; said at least one biological active payload enhancing damage/lethality of the at least one bullet wound by interacting with said bodily fluid of said target thereof.

14. The at least one biological active payload as set forth in claim 13 producing at least one of embolism, infarct, necrosis, hemorrhage, enhanced loss of perfusion, anticoagulation, or a combination thereof, after interacting with said bodily fluid of said target.

15. The at least one biological active material/substance as set forth in claim 13 comprising at least one material/substance selected from emboli, gas bubble producing materials/substances, toxins, antigens, coagulants, anticoagulants, or a combination thereof.

16. The at least one biological active payload as set forth in claim 13 further associated with an at least one adhesive.

17. A method of transforming a bullet projectile into a biological active bullet projectile before loading and firing from a firearm by first filling/associating an at least one payload housing with a biological active material/substance to form a biological active payload as described in claim 13, and next inserting, twisting, stuffing, filling, or a combination thereof, said biological active payload into an at least one externally facing cavity/channel of said bullet projectile.

* * * * *